United States Patent [19]
Kremp et al.
[11] 4,213,782
[45] Jul. 22, 1980

[54] PROCESS FOR REMOVAL OF SILVER FROM PHOTOGRAPHIC FILM

[76] Inventors: Richard E. Kremp, 4220 Swanson La., Reno, Nev. 89502; Fred N. Vandeman, 1617 Oakhurst Ave., Reno, Nev. 89507

[21] Appl. No.: 765,215

[22] Filed: Feb. 3, 1977

[51] Int. Cl.[2] ..... G03C 5/26
[52] U.S. Cl. ..... 430/432; 354/317; 134/9; 134/64 P
[58] Field of Search ..... 96/50 PL, 50 R, 82; 354/317; 134/9, 64 P

[56] References Cited

U.S. PATENT DOCUMENTS

| | | | |
|---|---|---|---|
| 2,572,576 | 10/1951 | Stybel | 134/3 |
| 2,997,937 | 8/1961 | Limberger | 354/317 |
| 3,546,149 | 12/1970 | Fabian | 260/2.3 |
| 3,886,576 | 5/1975 | Stoffel | 354/317 |
| 4,049,454 | 9/1977 | Van Doorselaer et al. | 96/82 |

*Primary Examiner*—J. Travis Brown
*Attorney, Agent, or Firm*—John Joseph Hall

[57] ABSTRACT

Processes and apparatus for removal of silver from exposed photographic film by transporting the film through hypochlorite solution in a reagent tank for a predetermined time, draining off precipitated silver chloride, washing the treated film in a wash tank, and drying the treated film in a dryer. Another embodiment of the process involves masking one side of exposed radiograph film, and removing the emulsion and/or the silver on only one side of the exposed radiograph.

4 Claims, 11 Drawing Figures

PROCESS FOR REMOVAL OF SILVER FROM PHOTOGRAPHIC FILM

SUMMARY OF THE INVENTION

The invention makes possible the total reclamation of silver used to produce photographic images, including any photographic film using silver halide or silver salts as a light sensitive material. The process is particularly adapted for use in recovering silver on x-ray produced radiographs.

A patient's radiographs are generally considered to be useful for a period of only from five to ten years in the absence of additional films taken because of physical changes of the patient due to age alone. Most radiology departments in hospitals or other institutions generally retire a large number of x-ray films taken in the past five or ten years.

The present process provides a method of removal of the silver from these radiographs, which amount to a large volume annually.

This process dispenses with the conventional methods of handling retired films by packaging and shipping the film to a silver reclaiming company. The process and apparatus permit the radiology department of a hospital or institution to recover the silver itself instead of disposing of the film at a relatively low cost to a silver reclaiming company. No additional personnel are needed to operate the apparatus and the expense of chemicals is relatively low. The recovered silver chloride is stored easily and refined easily.

Another embodiment of the process is used to reduce the density of overexposed radiographs by removing only one side of the two coated sides of radiograph film. The process employs a procedure of masking one side of the radiograph which can be done in several ways. A preferred method is attaching a plastic barrier to one side of the emulsion. Another method is to use a rubber or other barrier which is attached or allowed to dry on the emulsion on one side of the radiograph. A spray or other liquids may be used to protect the emulsion from the working solution.

The general process for removal of silver from exposed photographic film uses apparatus which combines components for providing each of the steps of the process in a single unit. The various components of the apparatus include means for transporting the film into a reagent tank, maintaining the film in the reagent tank for a predetermined period of time, removing the film from the tank, and transporting the film through a wash tank. The apparatus also provides for drying the film if desired, and provides a sedimentation tank to receive the precipitated silver chloride. Various methods of removal may be used beside sedimentation of th silver chloride, such as flotation, filtration, precipitation, or centrifugation. One embodiment of this invention uses a sloped bottom on the reagent tank to allow collection of the silver chloride at the bottom and a sediment drain tube to transport the sediment to a sedimentation tank.

Another embodiment of the invention involves the use of a sealed reaction chamber to confine the hypochlorite reagent to a fixed space to allow the solution to act upon one emulsion side of the film. The chamber is sealed by a rubber gasket or seat.

It is therefore, an object of this invention to provide a relatively simple process for the removal of silver from photographic films.

Another object of this invention is to produce a relatively inexpensive process for the removal of silver from photographic film.

A further object of this invention is to provide a process for removal of silver from one side of overexposed radiographic film.

Another further object of this invention is to provide a compact apparatus which contains components capable of carrying out the various steps of the process.

These and other objects will be more readily understood by reference to the following specification, taken in conjunction with the accompanying drawings, in which FIG. 1 is a perspective view of an embodiment of apparatus capable of carrying out the various steps of the process.

The process for removal of silver from photographic film includes various steps and operations provided by silver removal apparatus 10 having several components.

Figure 2:
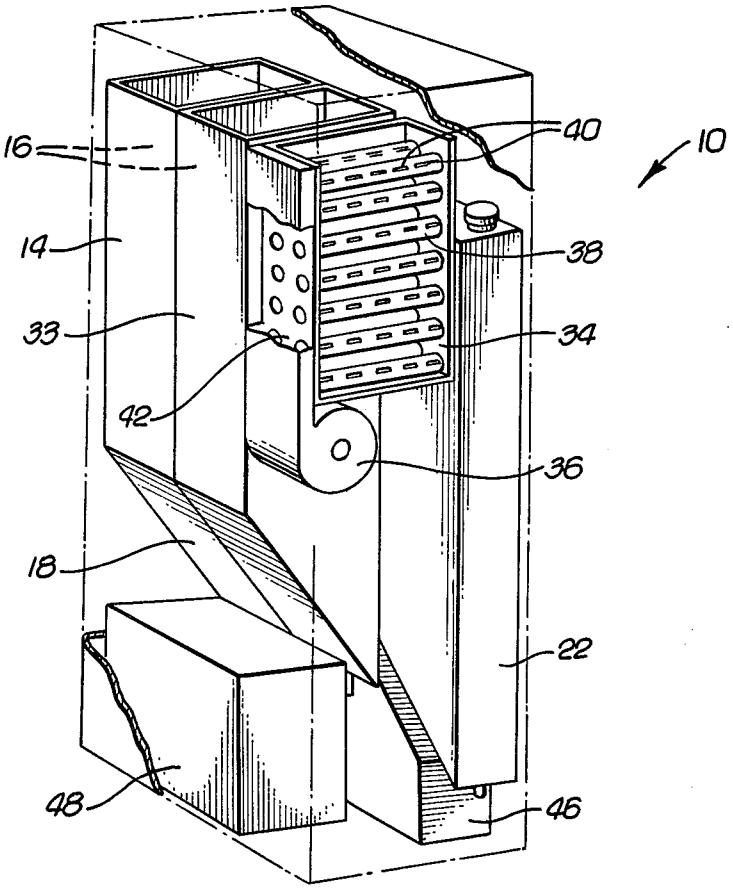
FIG. 2 is a view similar to FIG. 1 in which the apparatus cover has been cut away in sections to show a film dryer, a wash tank, a reagent tank, a reclaimer bin, and a replenisher tank.
Figure 1:
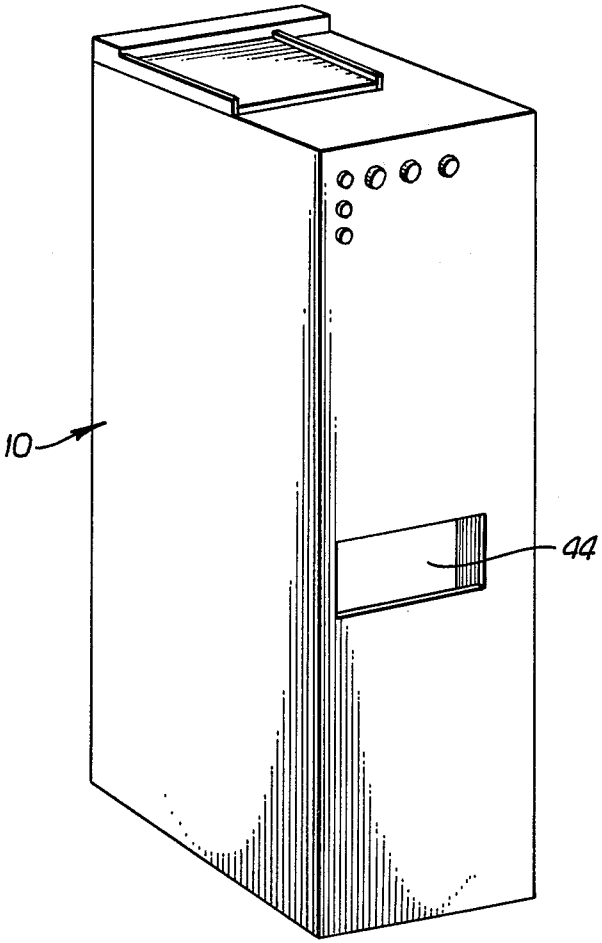
Figure 4:
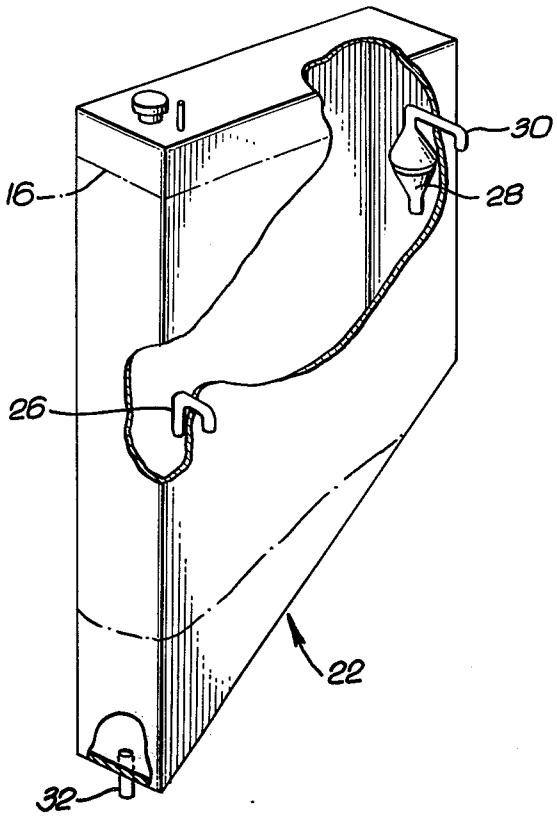
FIG. 4 is a perspective view partly in section of a sedimentation tank of the apparatus.
Figure 3:
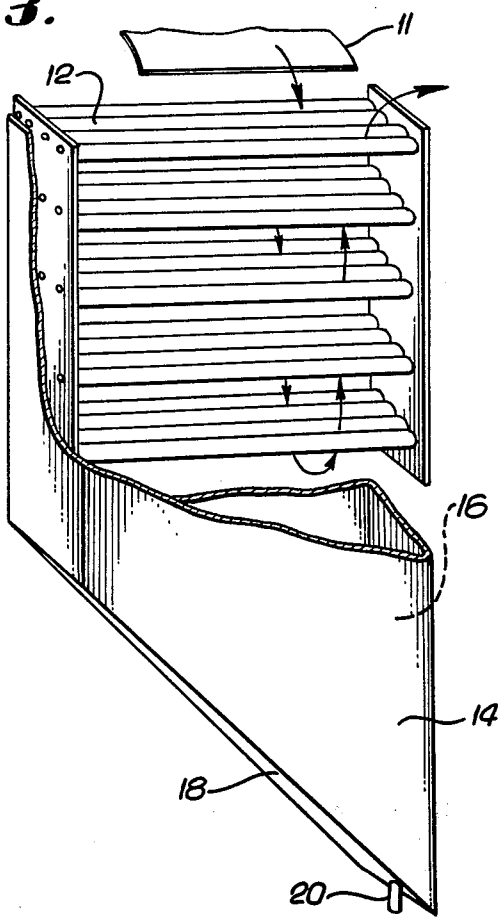
FIG. 3 is a perspective view partly in section showing the reagent tank with rollers for transporting photographic film.

The film 11 is transported by a transport means which can be of various types. FIG. 3 of the drawings illustrates a component part of apparatus 10 providing film transport by rollers 12 activated by an electric motor (not shown). Any other suitable means may be used, such as wheels or belts or the like.

Rollers 12 move the film 11 into the reagent tank 14 of apparatus 10, where the film 11 is maintained in solution for a predetermined period of time. The reagent tank 14 contains an aqueous hypochlorite solution 16 and has a sloped bottom 18 to collect the insoluble silver chloride precipitated after being formed.

A drain tube 20 draws off the silver chloride to sedimentation tank 22. Various methods may be used to collect or remove the silver chloride, including sedimentation, flotation, filtration, precipitation, or centrifugation.

The process preferably places sedimentation tank 22 in a position below the reagent tank 14 to allow gravitational flow from the reagent tank 14 and wash tank 24. The silver chloride sediment flows into the sedimentation tank 22 through inlet 26 and accumulates at the bottom undisturbed. The supernatant fluid is drained off by a valve 28 and drainage tube 30. A sediment harvest valve 32 collects the silver chloride for storage and later shipment to a refinery.

The roller transport system 12 then moves the film 11 to and through wash tank 33 to wash the film 11 from the hypochlorite solution.

If the film is to be dried, the roller transport system 12 then moves the film 11 to a dryer 34. Various methods of drying the film 11 can be used, such as heating lamps, hot boxes, and hot air blowers and the like.

The process preferably uses a hot air blower 36 provided with a set of hollow tubes 38 which have a slit 40 along the edge facing the film 11. A resistive heating assembly 42 heats air blown across it by blower 36. The heated air is then blown against the film 11, thereby drying the film. The film is then deposited in a film drop bin 44.

As an option, the apparatus 10 may be provided with a replenisher tank 46 for the reaction tank, and an electrolytic reclaimer bin 48 for the silver chloride.

Figure 5:
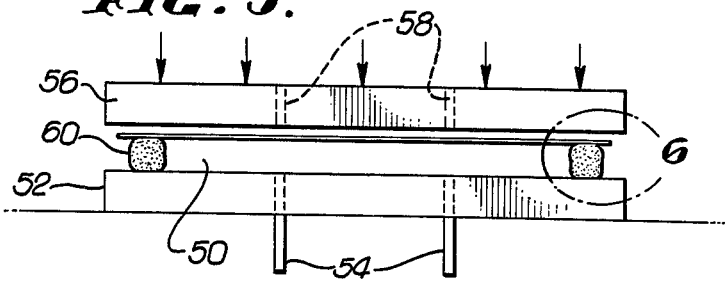
FIG. 5 is a cross-sectional view of a reaction chamber formed by a pressure plate, a backing plate, and a seal around the edges of the pressure plate and backing plate, with a radiograph film therein.
Figure 6:
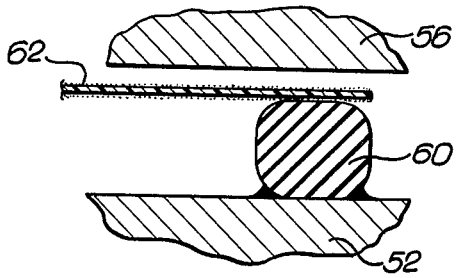
FIG. 6 is a view in detail of a portion of FIG. 5.

Another embodiment of our invention is illustrated in FIGS. 5 and 6 for removal of one emulsion side of radiographic film having two emulsion sides. A reaction chamber 50 is formed by a backing plate 52 having openings or tubes 54 or introducing hypochlorite solution and for drainage, and by a pressure plate 56 having venting holes 58. The backing plate 52 is congruent with the pressure plate 56 and forms reaction chamber 50 when sealed with a suitable sealing means such as rubber gasket 60.

The process may be used with apparatus 10 or with reaction chamber 50 to remove the emulsion from one side of radiographs having two emulsion sides. For this procedure, a barrier is necessary to protect the other emulsion side of the radiograph from the hypochlorite solution. Typical radiographs used in this procedure would be those that are over-exposed or over-developed. The process will reduce the density of such radiographs by 50%, making the radiographs easier to read and salvaging them from otherwise being discarded.

Various types of barriers may be used, such as a plastic or rubber barrier which is attached or allowed to dry on the emulsion to be protected. Suitable material can be sprayed on the emulsion side to be protected, or a solution treatment may be used to prevent the hypochlorite solution from entering the emulsion.

A preferred embodiment of a barrier for a radiograph 62 is a plastic mask 64 with an adhesive border 66. To properly attach the plastic mask 64 to the radiograph 62, the mask 64 is cut to the same size as radiograph 62 along with a piece of wax paper 68 or other paper with one side that does not stick to adhesive border 66.

Figure 7:
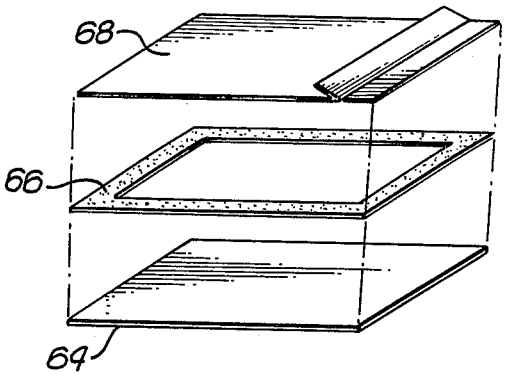
FIG. 7 is an exploded view in perspective of an emulsion mask for a radiograph, showing paper at the top over an adhesive border of a plastic mask at the bottom.
Figure 8:
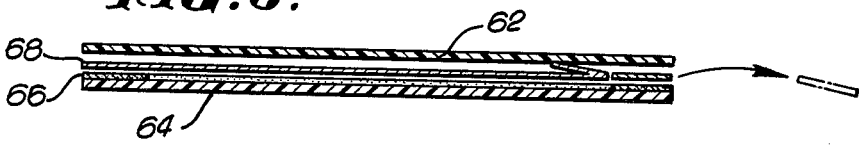
FIG. 8 is a cross-section of a radiograph in position and ready to be pressed on an emulsion mask.
Figure 9:
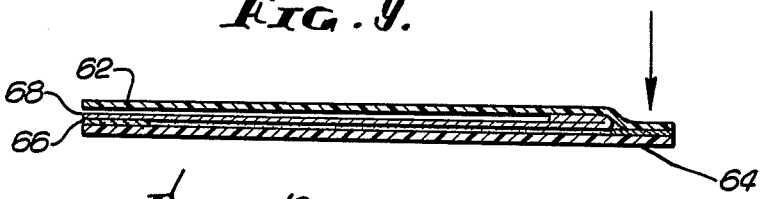
FIG. 9 is a cross-section of a radiograph superimposed on an emulsion mask with one end pressed against the adhesive end of the emulsion mask.
Figure 10:
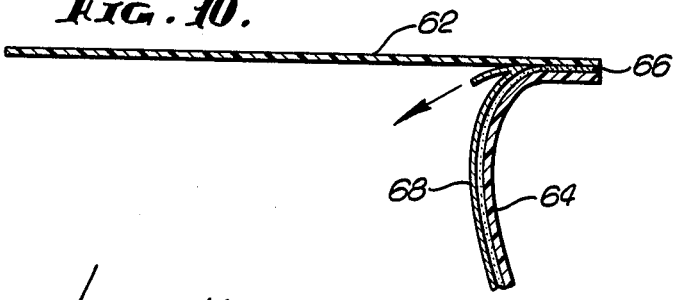
FIG. 10 is a cross-section of a radiograph having one end pressed against the adhesive end of an emulsion mask and shows the removal of a layer of paper.
Figure 11:
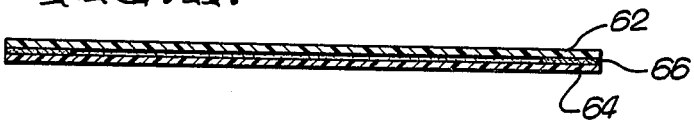
FIG. 11 is a cross-section of a radiograph with an emulsion mask in position covering one emulsion side of the radiograph.

The radiograph 62 is superimposed on the wax paper 68, one end of which has been removed and folded back as shown in FIGS. 7 and 8. Both the radiograph 62 and the wax paper 68 are then superimposed on the plastic mask 64. The end of the radiograph 62 congruent to the folded end of paper 68 is pressed down on the adhesive border 66 of the mask 64 as shown in FIG. 9. The paper 68 is then removed as shown in FIG. 10.

The remaining portion of radiograph 62 is then pressed down on the mask 64 in a fanning motion to prevent air bubbles between the surfaces of the radiograph 62 and mask 64.

The masked radiograph is then processed as disclosed above either through the use of apparatus 10 or reaction chamber 50. After treatment, the mask is pulled off, leaving a resulting radiograph whose density has been lowered by 50%, making it much easier to read, and salvaging over-exposed or over-developed radiographs that would otherwise be discarded.

Although we have described preferred embodiments of our invention, it is understood that numerous changes in construction and arrangement of parts may be made as well as changes in the steps of the processes disclosed within the scope of the invention as hereinafter claimed.

We claim:

1. A process for reducing the density of overexposed radiographic film having two emulsion sides, by removing silver from one side of said film, comprising:
   - placing a suitable barrier on one emulsion side of said radiographic film;
   - transporting the film into a reagent tank containing hypochlorite solution;
   - maintaining the film in said hypochlorite solution for a predetermined length of time;
   - collecting the precipitated silver chloride; washing the treated film, and drying the treated film; and removing said barrier.

2. A process according to claim 1 in which the barrier is plastic adhesively attached to one emulsion side of the film.

3. A process according to claim 1 in which the barrier is an elastomeric material adhesively attached to one emulsion side of the film.

4. A process according to claim 1 in which the barrier is a suitable protective material sprayed on one emulsion side of the film.

* * * * *